US008041245B2

(12) United States Patent
Barton et al.

(10) Patent No.: US 8,041,245 B2
(45) Date of Patent: Oct. 18, 2011

(54) APPARATUSES USEFUL IN PRINTING AND METHODS OF CONTROLLING THE TEMPERATURE OF SURFACES IN APPARATUSES USEFUL IN PRINTING

(75) Inventors: Augusto E. Barton, Webster, NY (US); Anthony S. Condello, Webster, NY (US); Daniel J. McVeigh, Webster, NY (US); Nicholas P. Kladias, Fresh Meadows, NY (US); Faming Li, Penfield, NY (US); Paul M. Fromm, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 30 days.

(21) Appl. No.: 12/550,808

(22) Filed: Aug. 31, 2009

(65) Prior Publication Data

US 2011/0052235 A1 Mar. 3, 2011

(51) Int. Cl.
*G03G 15/20* (2006.01)

(52) U.S. Cl. ..... 399/69

(58) Field of Classification Search ..... 399/69, 399/67

See application file for complete search history.

(56) References Cited

U.S. PATENT DOCUMENTS

| | | | | |
|---|---|---|---|---|
| 7,280,777 | B2 * | 10/2007 | Takahashi et al. | 399/45 |
| 7,428,390 | B2 * | 9/2008 | Ando | 399/67 |
| 7,546,051 | B2 * | 6/2009 | Sone et al. | 399/69 |
| 7,620,337 | B2 * | 11/2009 | Nakamoto et al. | 399/69 |
| 2002/0118982 | A1 | 8/2002 | Fuma | |
| 2002/0176724 | A1 | 11/2002 | Fuma et al. | |
| 2005/0254846 | A1 * | 11/2005 | Yura et al. | 399/67 |
| 2006/0013624 | A1 * | 1/2006 | Kurotaka et al. | 399/329 |
| 2008/0037069 | A1 | 2/2008 | Mestha et al. | |
| 2008/0181645 | A1 | 7/2008 | Nakamura | |

FOREIGN PATENT DOCUMENTS

EP 0682298 A1 11/1995

OTHER PUBLICATIONS

Anthony S. Condello et al.; "Fusers, Printing Apparatuses and Methods of Fusing Toner on Media"; U.S. Appl. No. 12/261,680, filed Oct. 30, 2008.

Nicholas P. Kladias et al.; "Apparatuses Useful for Printing and Methods for Controlling the Temperature of Media in Apparatuses Useful for Printing"; U.S. Appl. No. 12/352,824, filed Jan. 13, 2009.

European Search Report Issued on Nov. 12, 2010, in Related EP Application No. 10 173 927.4.

* cited by examiner

*Primary Examiner* — Constantine Hannaher

(74) *Attorney, Agent, or Firm* — Ronald E. Prass, Jr.; Prass LLP

(57) ABSTRACT

Apparatuses useful in printing and methods of controlling the temperature of surfaces in apparatuses useful in printing are provided. An exemplary embodiment of the apparatuses useful in printing includes a belt including a first surface; at least one heat source for heating the first surface; a roll including a second surface; a temperature sensor positioned to measure a temperature of the second surface; and a roll positioning device coupled to the roll for positioning the second surface of the roll in contact with the first surface of the belt to form a nip and increase the temperature of the second surface, and for positioning the second surface out of contact with the first surface to decrease the temperature of the second surface, in response to the temperature measured by the temperature sensor.

13 Claims, 6 Drawing Sheets

APPARATUSES USEFUL IN PRINTING AND METHODS OF CONTROLLING THE TEMPERATURE OF SURFACES IN APPARATUSES USEFUL IN PRINTING

BACKGROUND

Some printing apparatuses include a fixing device for fixing marking materials forming images onto media. Such fixing devices can include opposed members forming a nip. Media are fed to the nip where the members can heat and apply pressure to the media to fix the images.

It would be desirable to provide apparatuses useful in printing and methods of controlling the temperature of surfaces in such apparatuses that can provide desirable temperature control.

SUMMARY

Apparatuses useful in printing and methods of controlling the temperature of surfaces in apparatuses useful in printing are disclosed. An exemplary embodiment of the apparatuses useful in printing comprises a belt including a first surface; at least one heat source for heating the first surface; a roll including a second surface; a temperature sensor positioned to measure a temperature of the second surface; and a roll positioning device coupled to the roll for positioning the second surface of the roll in contact with the first surface of the belt to form a nip and increase the temperature of the second surface, and for positioning the second surface out of contact with the first surface to decrease the temperature of the second surface, in response to the temperature measured by the temperature sensor.

DRAWINGS

Figure 6:
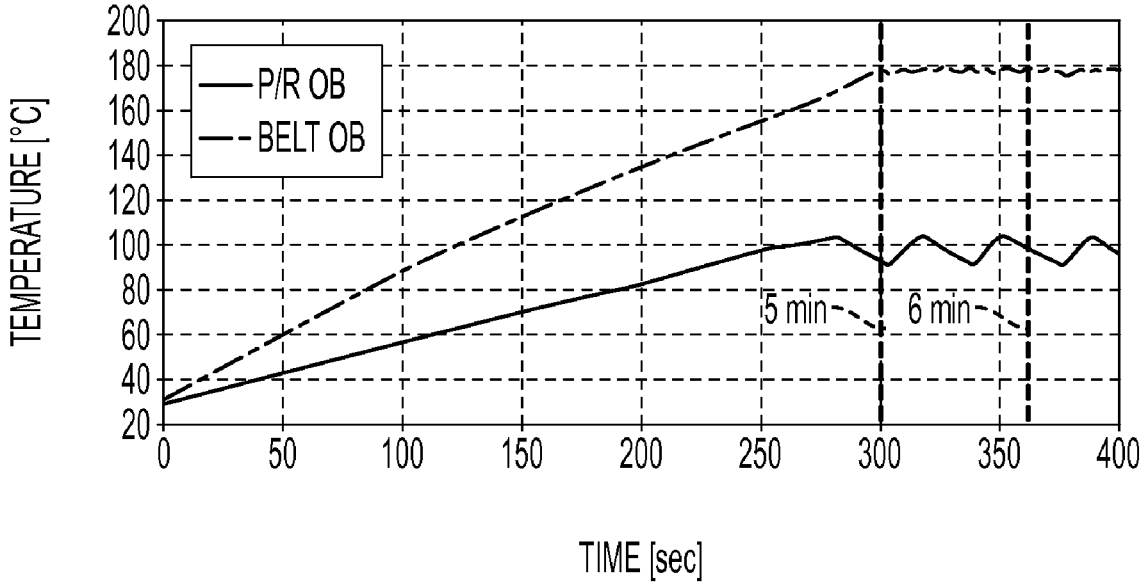

FIG. 6 illustrates curves showing the temperature at the outer surface of a pressure roll (P/R) and the outer surface of a belt, as a function of warm-up time, where the outer surface of the pressure roll is heated from ambient temperature to a set temperature by moving the pressure roll into contact with the belt, and then the temperature of the outer surface of the pressure roll is controlled to within a selected temperature range by moving the pressure roll into and out of contact with the belt.

DETAILED DESCRIPTION

The disclosed embodiments include apparatuses useful for printing. An exemplary embodiment of the apparatuses comprises a belt including a first surface; at least one heat source for heating the first surface; a roll including a second surface; a temperature sensor positioned to measure a temperature of the second surface; and a roll positioning device coupled to the roll for positioning the second surface of the roll in contact with the first surface of the belt to form a nip and increase the temperature of the second surface, and for positioning the second surface out of contact with the first surface to decrease the temperature of the second surface, in response to the temperature measured by the temperature sensor.

The disclosed embodiments further include an exemplary apparatus useful in printing, which comprises a first roll including a first surface; a heat source for heating the first surface; a second roll including a second surface; a temperature sensor positioned to measure a temperature of the second surface; and a roll positioning device coupled to the second roll for positioning the second surface of the second roll in contact with the first surface of the first roll to form a nip and increase the temperature of the second surface, and for positioning the second surface out of contact with the first surface to decrease the temperature of the second surface, in response to the temperature measured by the temperature sensor.

The disclosed embodiments further include methods of controlling the temperature of a surface in an apparatus useful in printing. An exemplary embodiment of the methods comprises heating a first surface of a first roll or a belt; measuring a temperature of a second surface of a second roll; positioning the second surface of the second roll in contact with the first surface to form a nip and increase the temperature of the second surface to a first temperature; and positioning the second surface of the second roll out of contact with the first surface to decrease the temperature of the second surface to a second temperature, in response to the temperature measured by the temperature sensor.

As used herein, the term "printing apparatus" encompasses any apparatus that can perform a print outputting function for any purpose. Exemplary printing apparatuses can include digital copiers, bookmaking machines, facsimile machines, multifunction machines, and the like, as well as portions of such apparatuses.

Figure 1:
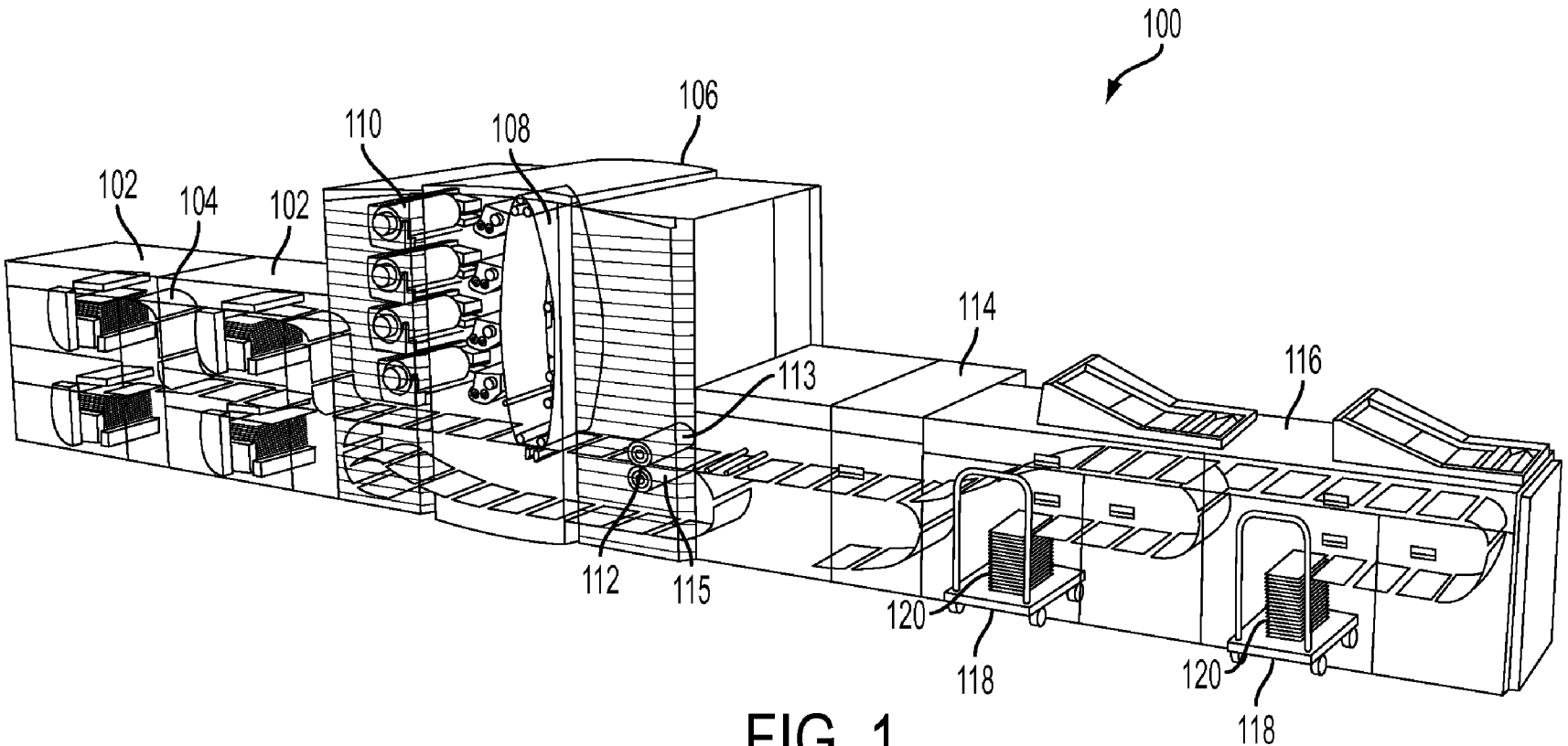
FIG. 1 illustrates an exemplary embodiment of a printing apparatus.

FIG. 1 illustrates an exemplary printing apparatus 100 disclosed in U.S. Patent Application Publication No. 2008/0037069, which is incorporated herein by reference in its entirety. The printing apparatus 100 includes two media feeder modules 102 arranged in series, a printer module 106 adjacent the media feeder modules 102, an inverter module 114 adjacent the printer module 106, and two stacker modules 116 arranged in series adjacent the inverter module 114.

In the printing apparatus 100, the media feeder modules 102 feed media (e.g., paper sheets) to the printer module 106. In the printer module 106, marking material (toner) is transferred from a series of developer stations 110 to a charged photoreceptor belt 108 to form images on the photoreceptor belt and produce color prints. The images are transferred to one side of respective media 104 fed through the paper path. The media are advanced through a fuser 112 including a fuser roll 113 and pressure roll 115. At the fuser 112, heat and pressure are applied to the media to fix the images onto the media. The inverter module 114 manipulates media exiting the printer module 106 by either passing the media through to the stacker modules 116, or inverting and returning the media to the printer module 106. In the stacker modules 116, the printed media are loaded onto stacker carts 118 to form stacks 120.

Figure 2:
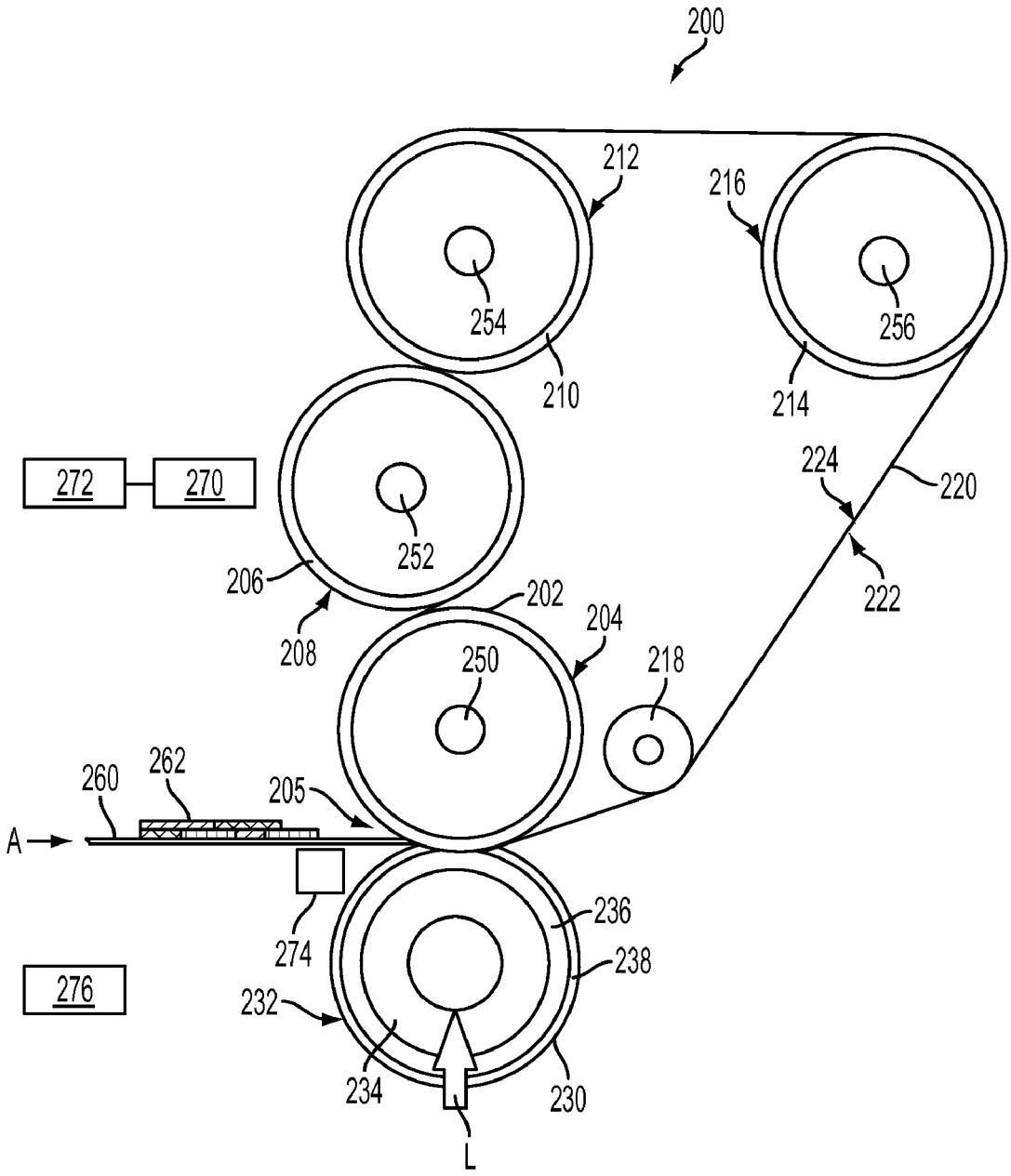
FIG. 2 illustrates an exemplary embodiment of a fixing device including a pressure roll and a belt forming a nip.

FIG. 2 illustrates an exemplary fuser 200 according to the disclosed embodiments. Embodiments of the fuser 200, as well as other fixing devices according to disclosed embodiments, can be used in different types of printing apparatuses.

For example, in the printing apparatus 100 shown in FIG. 1, the fuser 200 can be used in place of the fuser 112 to fix images on media.

The fuser 200 includes an endless (continuous) belt 220 supported by a fuser roll 202, external roll 206, internal rolls 210, 214 and an idler roll 218. The belt 220 has an outer surface 222 and an inner surface 224. Other embodiments of the fusers can include different numbers and configurations of rolls supporting the belt.

The fuser roll 202, external roll 206 and internal rolls 210, 214 include outer surfaces 204, 208, 212 and 214, respectively, contacting the belt 220, and internal heating elements 250, 252, 254 and 256, respectively. The heating elements 250, 252, 254 and 256 can each include at least one axially-extending lamp connected to a power supply 270. A controller 272 is connected to the power supply 270 to control the heating elements 250, 252, 254 and 256.

The fuser 200 further includes a pressure roll 230 having an outer surface 232. The outer surface 232 and the outer surface 222 of the belt 220 form a nip 205. The illustrated pressure roll 230 includes a core 234, an inner layer 236 on the core 234, and an outer layer 238 on the inner layer 236. The core 234 can comprise a rigid metal, such as aluminum, aluminum alloys, steels, or the like. The inner layer 236 can comprise an elastomeric material, such as silicone rubber, or the like. The inner layer 236 can typically have a thickness of about 14 mm to about 18 mm. The outer layer 238 can comprise a polymer, such as polytetrafluoroethylene (Teflon®), or the like, to reduce adhesion between the outer surface 232 and the outer surface 222 of the belt 220, and between the outer surface 232 and media fed to the nip 205.

The fuser 200 further includes a temperature sensor 274 positioned to sense the temperature of the outer surface 232 of the pressure roll 230. The temperature sensor 274 can be positioned adjacent (as shown), or in contact with, the outer surface 232. The temperature sensor 274 can be positioned, e.g., at about a 6 o'clock position to about a 10 o'clock position about the outer surface 232 in the illustrated configuration of the fuser 200. The temperature sensor 274 is connected to a controller 276 to provide feedback of the temperature of the outer surface 232 of the pressure roll 230.

Embodiments of the belt 220 can have a multi-layer construction including, e.g., a base layer forming the inner surface 224 of the belt 220, an intermediate layer on the base layer, and an outer layer on the inner layer forming the outer surface 222 of the belt 220. In an exemplary embodiment of the belt 220, the base layer is comprised of polyimide, or the like; the intermediate layer is comprised of an elastomer, such as silicone, or the like; and the outer layer is comprised of a low-friction polymer, such as a fluoroelastomer sold under the trademark Viton® by DuPont Performance Elastomers, L.L.C., polytetrafluoroethylene, or the like.

The belt 220 can have a thickness of about 0.1 mm to about 0.6 mm, for example. For example, in embodiments, the base layer can have a thickness of about 50 μm to about 100 μm, the intermediate layer a thickness of about 150 μm to about 200 μm, and the outer layer a thickness of about 20 μm to about 40 μm. The belt 220 can typically have a width of about 350 mm to about 450 mm, and a length of about 500 mm to at least about 1000 mm.

FIG. 2 depicts a medium 260 on which images 262 have been formed moving in process direction A of the apparatus and entering the nip 205. The fuser roll 202 is rotated counter-clockwise, and the pressure roll 220 is rotated clockwise, to convey the medium 260 through the nip 205. The medium 260 can be a sheet of paper, for example. Typically, paper can be classified as light-weight: ≦about 75 gsm, medium-weight: about 75 gsm to about 160 gsm, or heavy-weight: ≧160 gsm.

The outer surface 232 of the pressure roll 230 is deformed when positioned in contact with the fuser belt 220, as shown. The outer surface 204 of the fuser roll 202 may also be deformed by this contact depending on its composition and hardness. In the fuser 200, the pressure roll 230 is movable into contact and away from contact with the belt 220. This movement can be linear in reverse directions, for example. The width of nip 205 in the process direction is determined by the magnitude of the load, L, applied by the pressure roll 230 to the belt 220. The load L produces pressure between the outer surface 232 of the pressure roll 230 and the outer surface 222 of the belt 220 positioned between the outer surface 204 of the fuser roll 202 and the outer surface 232 of the pressure roll 230. The amount of deformation of the inner layer 236 and the outer layer 238 including the outer surface 232 of the pressure roll 230 is affected by the amount of pressure produced by the load L and the hardness of the materials forming the inner layer 236 and outer layer 238 of the pressure roll 230.

It has been noted that in belt-type fusers that include a pressure roll with a thick layer of silicone rubber, or the like, overlying a core, and a thin belt, the temperature of the outer surface of the pressure roll can vary significantly during print jobs when different types of media are printed. In these apparatuses, higher pressure roll outer surface temperatures occur when thin media are used as compared to thick media. Such high pressure roll outer surface temperatures can adversely affect print quality in thin media.

It has also been noted that controlling the temperature of the outer surface of a pressure roll that includes a thick layer of silicone rubber, or the like, overlying a metal core, by using an internal heat source, e.g., a heat lamp inside the core, may not be sufficiently-efficient and accurate because heat must be conducted outward in the radial direction through the thick layer to the outer surface of the pressure roll. In such apparatuses, the core is heated by the internal heat source and heat then must be conducted outwardly to the outer surface of the pressure roll. Due to the low thermal conductivity of such thick layers of silicone rubber, or the like, this internal heating produces higher core temperatures than when heating the pressure roll from the outside to warm-up the pressure roll within the same amount of time. This makes the use of a heating element inside of the pressure roll inefficient compared to heating the pressure roll from the outside. These high temperatures can cause de-bonding of the rubber layer from the core. Moreover, if the pressure roll were to be heated from the inside without exceeding the silicone de-bonding temperature, it would take an excessive amount of time to reach the desired temperature.

It has further been noted that when the pressure roll outer surface is not heated before a first print is made, thin media will be fused at lower media/marking material interface temperatures at the beginning of print runs. Consequently, some prints will have unsatisfactory image quality.

In such apparatuses including an internal heat source for heating the pressure roll, during long print jobs, especially when using thin media, the outer surface of the pressure roll can reach temperatures at least 25° C. higher than the target temperature. Such temperature increases, and associated reductions of durometer, of the pressure roll can increase the size of the nip. Consequently, in such apparatuses, to reduce overheating of the pressure roll and reductions of image quality, the outer surface of the pressure roll is typically externally cooled during print jobs with an external cooling device, such as using a cooling air flow or a cooling shoe, to maintain the outer surface temperature near the target temperature. However, this external cooling of the pressure roll obviates the function of the internal heat source during the print jobs.

Accordingly, it is desirable to heat the pressure roll outer surface to a temperature close to the operating temperature prior to making first prints in fusers, to reduce temperature changes of the pressure roll outer surface during print runs and achieve more-consistent media/marking material interface temperatures at the beginning of, and also throughout print runs.

In embodiments of the fuser 200, the temperature of the outer surface 232 of the pressure roll 230 is increased by moving the pressure roll 230 into contact with the heated belt 220 to heat the outer surface 232 to an elevated temperature during warm-up. Heat is transferred from the outer surface 222 of the belt 220 to the outer surface 232 of the pressure roll 230 at the nip 205 where the outer surfaces 222, 232 are in contact with each other. Once the temperature of the outer surface 232 reaches about a selected maximum temperature during this heating, the pressure roll 230 is moved away from contact with the belt 220 to allow the outer surface 232 to cool to about a selected minimum temperature, to avoid heating the outer surface 232 to above the selected maximum temperature during the warm-up. In embodiments, the temperature of the outer surface 232 of the pressure roll 230 can be controlled between the selected maximum and minimum temperatures without using a heat source inside of the pressure roll 230 to heat the outer surface 232, or an external cooling device to cool the outer surface 232.

In embodiments, the temperature sensor 274 monitors the temperature of the outer surface 232 of the pressure roll 230 and provides temperature feedback to the controller 276. In an exemplary embodiment, during warm-up of the pressure roll 230 from ambient temperature, the pressure roll 230 is moved into contact with the belt 220 (which is also at ambient temperature). The belt 220 is then heated by powering the heating elements 250, 252, 254 and 256 under control of the controller 272. The pressure roll 230 is maintained in contact with the belt 220 until the feedback temperature of the outer surface 232 measured by the temperature sensor 274 reaches the maximum selected temperature. The maximum selected temperature can be, e.g., about 3° C. to about 10° C., such as about 5°, above a target temperature. Once the maximum selected temperature is reached, the pressure roll 230 is moved away from contact with the belt 220 to allow the outer surface 232 to cool to about a selected minimum temperature. The maximum selected temperature can be, e.g., about 3° C. to about 10° C. below the target temperature. The pressure roll 230 can then again be moved into contact with the belt 220 to heat the outer surface 232 to about the selected maximum temperature, and then moved out of contact with the belt 220 to again allow the temperature of the outer surface 232 to fall to about the selected minimum temperature, until the print run begins. This movement of the pressure roll 230 into and out of contact with the belt 220 can be repeated until the print run begins so that the temperature of the outer surface 232 is at or about the target temperature at the time the print run begins. Once the print run begins, the pressure roll 230 is maintained in contact with the belt 220 to form the nip 205.

The target temperature of the outer surface 232 of the pressure roll 230 can typically be about 100° C. to about 125° C. The target temperature is typically higher for thick media than for thin media. The pressure roll 230 can typically be warmed-up to the target temperature in less than about 5 minutes by contacting the pressure roll 230 with the rotating belt 220 and heating the belt 220, without any internal heating of the pressure roll 230. By heating the outer surface 232 of the pressure roll 230 directly externally, as opposed to internally, the temperature of the core 234 of the pressure roll 230 can be significantly reduced as compared to internally-heated pressure rolls. Once the selected maximum temperature of the outer surface 232 is reached, the pressure roll 230 can be moved into contact with the heated belt 220 for a first amount of time, and then moved away from contact with the heated belt 220 for a longer, second amount of time, to allow the temperature of the outer surface 232 to fall to about the selected minimum temperature. The heating and cooling rates of the outer surface 232 and the first and second amounts of time are dependent on factors, such as the power ratings of the heating elements 250, 252, 254, 256, the thickness and thermal conductivity of the belt 220, the temperature of the outer surface 222 of the belt 220, and the thickness of the media run in the fuser 200.

This technique of heating the outer surface 232 of the pressure roll 230 externally with the belt 220 is more efficient than actively heating the cold pressure roll 230 to the target temperature prior to the start of the print job using an internal heat source. Such active internal heating typically takes a significant amount of time, e.g., about 15 min., due to the thickness and low thermal conductivity of the inner layer 236 of the pressure roll 230.

Combining temperature feedback with controlled contact between the pressure roll 230 and belt 220 during warm-up in the fuser 200 allows a stable temperature of the outer surface 232 to be maintained throughout a print job for different media types. Different media types can include lightweight coated paper, medium-weight coated paper, heavy-weight coated paper, lightweight uncoated paper, medium-weight uncoated paper, heavy-weight uncoated paper, transparencies, and packaging materials.

Embodiments of the apparatuses are constructed to allow the pressure roll to be moved into and out of contact with the belt in a controlled manner in response to temperature feedback from the temperature sensor. In addition, the pressure roll can be moved relative to the belt to vary the nip width in the process direction to provide closer control of the temperature of the outer surface of the pressure roll during warm-up, and between print jobs.

Figure 3:
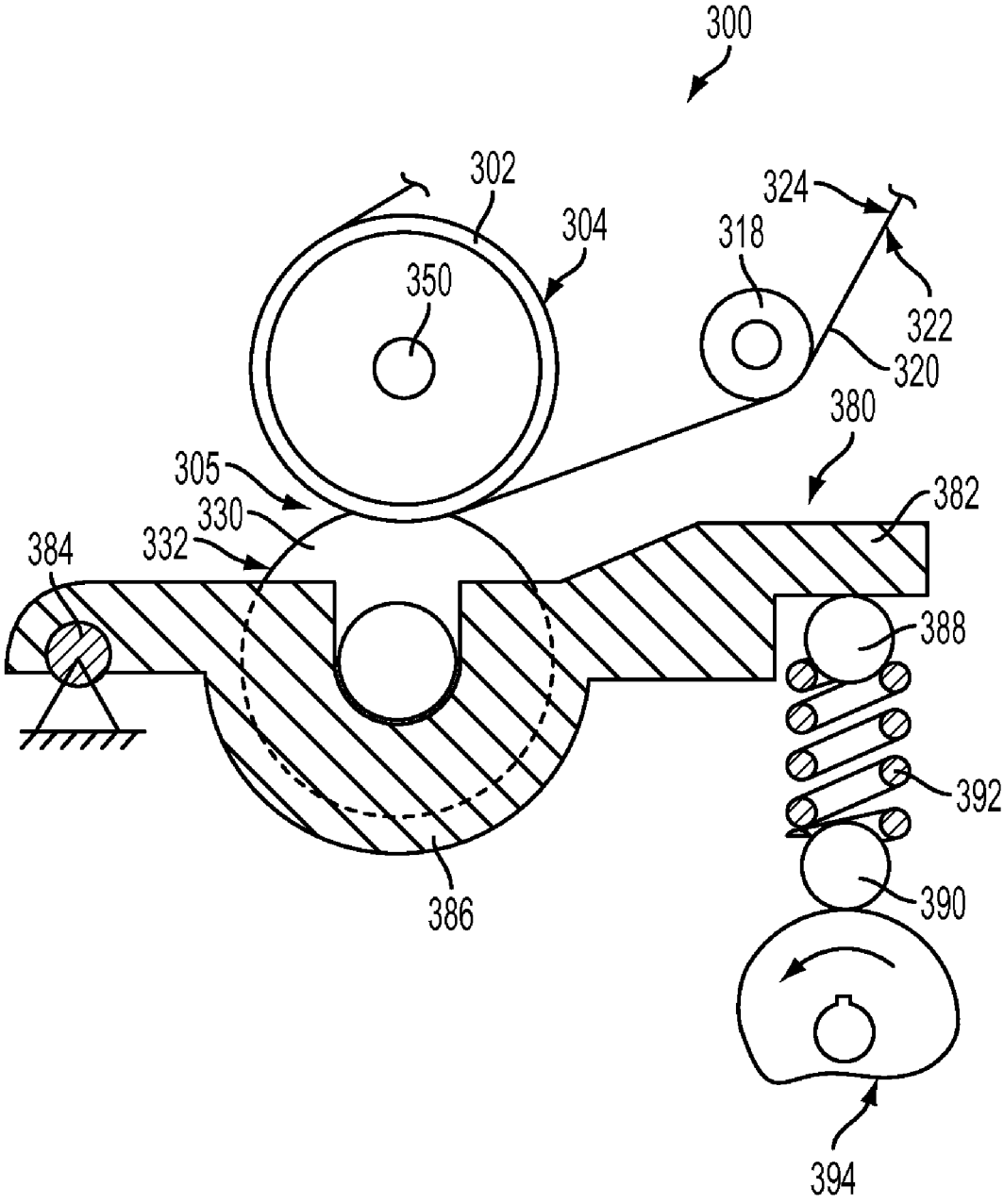
FIG. 3 illustrates an exemplary embodiment of a fixing device including a roll positioning device for moving a pressure roll relative to a belt.

FIG. 3 depicts an exemplary embodiment of a fuser 300 including a roll positioning device 380 coupled to the pressure roll 330. The roll positioning device 380 is operable to move the pressure roll 330 into and away from contact with the belt 320 supported on the fuser roll 302. The fuser roll 302, pressure roll 330 and belt 320 can have the same configurations as the fuser roll 202, pressure roll 230 and belt 220, respectively, shown in FIG. 2. The fuser 300 can include one or more rolls (not shown), such as the rolls 206, 210 and 214 of the fuser 200, to support the belt 320.

FIG. 3 shows the outer surface 332 of the pressure roll 330 positioned in contact with the outer surface 322 of the belt 320. The roll positioning device 380 includes an arm 382 having a surface 386 configured to support the pressure roll 330. The roll positioning device 380 further includes a pivot 384, such as a ball or roller, about which the arm 382 can be pivoted either counter-clockwise to move the pressure roll 330 toward the belt 320 to increase the width of nip 305, or clockwise to move the pressure roll 330 away from the belt 320 to decrease the width of nip 305. The roll positioning device 380 includes a rotatable cam 394. The cam 394 can be mounted on a rotatable shaft, for example. At least one compression spring 392 is positioned between rollers 388, 390. The spring 392 acts to resiliently bias the arm 382 via the roller 388, and to resiliently bias the cam 394 via the roller 390.

The arm 382 is caused to pivot about the pivot 384 by rotating the cam 394. In the illustrated embodiment, the cam 394 is rotated counter-clockwise to cause the arm 382 to pivot either clockwise or counter-clockwise depending on the location of the outer surface of the cam 394 that contacts the roller 390. The outer surface of the cam 394 is shaped to include two or more contact points (settings). For example, when the roller 390 is in contact with a first contact point, the spring 392 resiliently urges the roller 388 against the arm 382 to produce a first width of nip 305. Rotation of the cam 394 to move a second contact point of its surface into contact with the roller 390 causes the arm 382 to rotate counter-clockwise (i.e., upward in the illustrated orientation), causing the roller 330 to apply a larger load against the belt 320 and fuser roll 302, which increases the width of nip 305 to a second width and increases the contact surface area between the outer surface 332 and the outer surface 322 of belt 320. The larger second width of nip 305 provides a higher heating rate of the outer surface 332 of the pressure roll 330 than the first width of nip 305. The cam 394 can include additional settings to provide a range of nip widths and heating rates of the pressure roll 330. In embodiments, it may be desirable to use the setting of the cam 394 that provides the smallest width during heating and cooling of the pressure roll 330 to produce less stress on the belt 320, pressure roll 330 and roll positioning device 380.

Rotation of the cam 394 to move a third contact point of its surface into contact with the roller 390 causes the arm 382 to rotate clockwise (i.e., drop down in the illustrated orientation), causing the pressure roll 330 to move away from contact with the belt 320 (produce a nip of zero width) to allow the outer surface 332 to cool. In this position, the outer surface 332 of the pressure roll 330 can typically be spaced about 5 mm to about 10 mm from the belt 320.

In embodiments, the roll positioning device 380 is connected to the controller to which the temperature sensor for measuring the temperature of the outer surface of the pressure roll provides feedback. The controller allows the cam 394 to be rapidly activated to provide rapid movement of the pressure roll 330 relative to the belt 320 to heat or cool the outer surface 332. The roll positioning device 380 allows the position of the pressure roll 330 to be adjusted during warm-up and print jobs.

In other embodiments, the roll positioning device can include other types of elements for moving the pressure roll. For example, the roll positioning device can include a solenoid coupled to the pressure roll and connected to the controller to provide this controlled movement.

Figure 4:
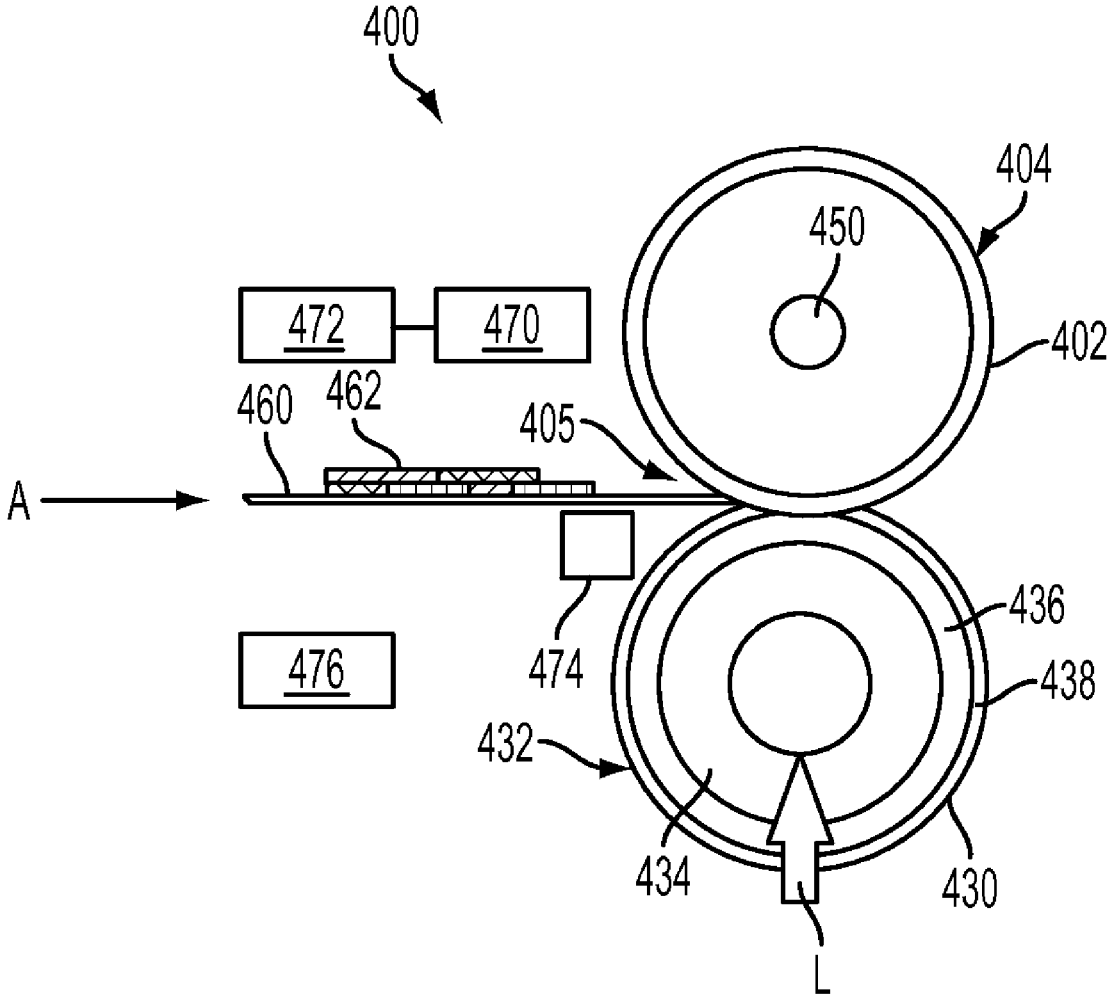
FIG. 4 illustrates an exemplary embodiment of a fixing device including a pressure roll and a fuser roll forming a nip.

Other embodiments of the fusers can include a fuser roll as the fusing member that contacts and heats the pressure roll. FIG. 4 depicts an exemplary embodiment of a fuser 400 including a pressure roll 430 and fuser roll 402. A heating element 450 is provided inside of the fuser roll 402. The pressure roll 430 includes an outer surface 432 shown positioned in contact with the outer surface 404 of the fuser roll 402 to form a nip 405. A medium 460 on which marking material 462 has been applied is shown moving in process direction A and entering the nip 405. The pressure roll 430 includes a core 434, inner layer 436 and outer layer 438, which can be comprised of the same materials as the respective core 334, inner layer 336 and outer layer 338 of the pressure roll 330, for example. A temperature sensor 474 is positioned to measure the temperature of the outer surface 432 of the pressure roll 430 in the vicinity of the nip 405. The temperature sensor 474 is connected to a controller 476 to provide feedback of the temperature of the outer surface 432.

In embodiments, the pressure roll 430 can be moved into and out of contact with the heated fuser roll 402 to control heating and cooling of the outer surface 432, using a roll positioning device (not shown) attached to the pressure roll 430. For example, the roll positioning device of the fuser 400 can have the same construction as the roll positioning device 380 shown in FIG. 3. The roll positioning device of the fuser 400 is connected to the controller 476, which can be configured to activate the roll positioning device in response to temperature feedback from the temperature sensor 474, to move the pressure roll 430 relative to the fuser roll 402 during warm-up, and between print jobs to control the temperature of the outer surface 432.

It will be understood that the teachings and claims herein can be applied to any treatment of marking materials on media. For example, the marking material can be a toner, liquid or gel ink, and/or heat- or radiation-curable ink; and/or the media can utilize certain process conditions, such as temperature, for successful printing. The process conditions, such as heat, applied pressure and other conditions that are desired for the treatment of ink on media in a given embodiment may be different from the conditions that are suitable for fusing.

Examples

Figure 5:
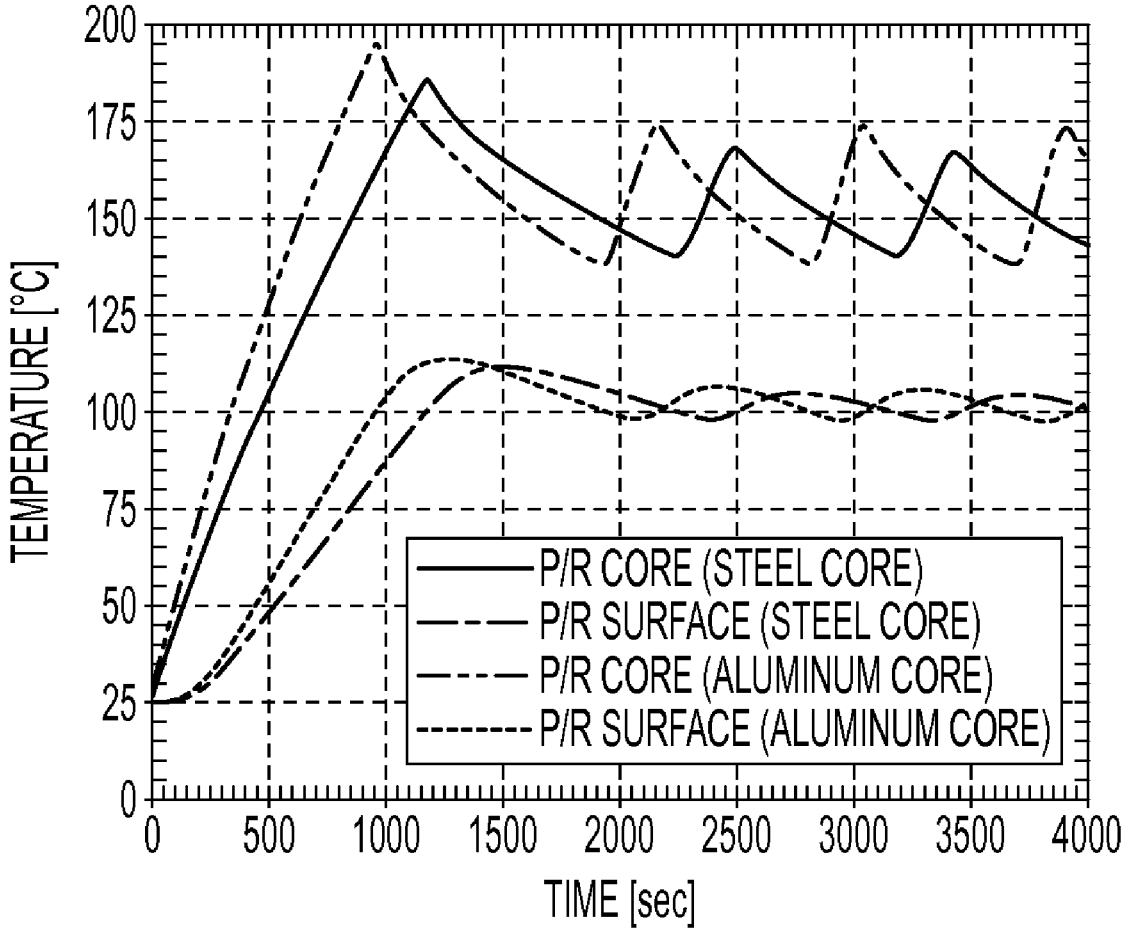
FIG. 5 illustrates curves showing the temperature at the core and outer surface of a pressure roll (P/R) having a steel core and a pressure roll having an aluminum core with internal heating of the pressure rolls, as a function of warm-up time.

FIG. 5 depicts modeled curves showing the temperature at the core and outer surface of a pressure roll (P/R) having a steel core and a pressure roll having an aluminum core, as a function of warm-up time. Each roll is internally heated with a heating source that produces a power of 1000 W. As shown, the outer surface of each pressure roll reaches a temperature of about 100° C. in about 15 minutes from ambient temperature. The cores of the pressure rolls reach temperatures of about 200° C. during warm-up.

FIG. 6 depicts curves showing the temperature at the outer surface of a pressure roll (P/R) and at the outer surface of a belt as a function of warm-up time. The belt and the outer surface of the pressure roll are heated from ambient temperature with the pressure roll in contact with the belt. The belt is heated with 7000 watts of power. The belt reaches a selected maximum temperature of about 105° C. in less than 5 minutes from ambient temperature. The standby temperature of the belt is 100° C. The belt reaches a standby temperature of about 180° C. The outer surface temperature of the pressure roll is then controlled about the standby temperature by repeatedly moving the pressure roll into contact with the belt for about 13 seconds until the outer surface reaches the selected maximum temperature of about 105° C. and then moving the pressure roll out of contact with the belt for about 26 seconds until the outer surface temperature falls to a selected minimum temperature of about 95° C.

It will be appreciated that various ones of the above-disclosed, as well as other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. An apparatus useful in printing, comprising:

a belt including a first surface;

at least one heat source for heating the first surface;

a roll including a second surface, wherein the roll does not include an internal heat source for heating the second surface and the apparatus does not include an external cooling device for cooling the second surface;

a temperature sensor positioned to measure a temperature of the second surface; and a roll positioning device coupled to the roll for positioning the second surface of the roll in contact with the first surface of the belt to form a nip and increase the temperature of the second surface, and for positioning the second surface out of contact with the first surface to decrease the temperature of the second surface, in response to the temperature measured by the temperature sensor, wherein the roll positioning device comprises:

an arm supporting the roll, the arm being rotatable in first and second directions wherein the roll is coupled to the arm so that the ends of the roll are not enclosed by the arm in a manner that allows the roll to be easily rotatable and removable;

a cam; and at least one spring positioned to resiliently bias the arm and the cam;

wherein the cam is selectively rotatable to cause the arm to rotate in the first direction which moves the roll toward the belt, or to cause the arm to rotate in the second direction which moves the roll away from the belt, and includes a contoured surface having a plurality of settings including at least:

a first setting at which the second surface is positioned to contact the first surface and form the nip having a first width in a process direction of the apparatus;

a second setting at which the second surface is positioned to contact the first surface and form the nip having a second width larger than the first width in the process direction;

a third setting at which the second surface is positioned out of contact with the first surface; and a fourth setting that provides the smallest width during heating and cooling of the roll to produce less stress on the belt, the roll, and the roll positioning device.

2. The apparatus of claim 1, wherein:

the belt has a thickness of about 0.1 mm to about 0.6 mm; and the roll includes a layer comprised of an elastomeric material which is deformed when the second surface contacts the first surface to form the nip.

3. The apparatus of claim 1, wherein the temperature sensor and the roll positioning device are connected to a controller configured to control actuation of the roll positioning device to move the roll relative to the belt in response to signals sent to the controller by the temperature sensor to control the temperature of the second surface of the roll.

4. An apparatus useful in printing, comprising:

a first roll including a first surface;

a heat source for heating the first surface;

a second roll including a second surface, wherein the second roll does not include an internal heat source for heating the second surface and the apparatus does not include an external cooling device for cooling the second surface;

a temperature sensor positioned to measure a temperature of the second surface; and a roll positioning device coupled to the second roll for positioning the second surface of the second roll in contact with the first surface of the first roll to form a nip and increase the temperature of the second surface, and for positioning the second surface out of contact with the first surface to decrease the temperature of the second surface, in response to the temperature measured by the temperature sensor, wherein the roll positioning device comprises:

an arm supporting the second roll, the arm being rotatable in first and second directions wherein the second roll is coupled to the arm so that the ends of the second roll are not enclosed by the arm in a manner that allows the second roll to be easily rotatable and removable;

a cam; and at least one spring positioned to resiliently bias the arm and the cam;

wherein the cam is selectively rotatable to cause the arm to rotate in the first direction which moves the second roll toward the first roll, or to cause the arm to rotate in the second direction which moves the second roll away from the first roll, and includes a contoured surface having a plurality of settings including at least:

a first setting at which the second surface is positioned to contact the first surface and form the nip having a first width in a process direction of the apparatus;

a second setting at which the second surface is positioned to contact the first surface and form the nip having a second width larger than the first width in the process direction;

a third setting at which the second surface is positioned out of contact with the first surface; and a fourth setting that provides the smallest width during heating and cooling of the second roll to produce less stress on the second roll and the roll positioning device.

5. The apparatus of claim 4, wherein the second roll includes a layer comprised of an elastomeric material which is deformed when the second surface contacts the first surface to form the nip.

6. The apparatus of claim 4, wherein the temperature sensor and the roll positioning device are connected to a controller which controls actuation of the roll positioning device to move the second roll relative to the first roll in response to signals sent from the temperature sensor to the controller to control the temperature of the second surface of the second roll.

7. A method of controlling the temperature of a surface in an apparatus useful in printing, comprising:

heating a first surface of a first roll or a belt;

measuring a temperature of a second surface of a second roll, wherein the second roll does not include an internal heat source for heating the second surface and the apparatus does not include an external cooling device for cooling the second surface;

positioning the second surface of the second roll in contact with the first surface using a roll positioning device to form a nip and increase the temperature of the second surface to a first temperature; and positioning the second surface of the second roll out of contact with the first surface using the roll positioning device to decrease the temperature of the second surface to a second temperature, in response to the temperature measured by the temperature sensor, wherein the roll positioning device comprises:

an arm supporting the second roll, the arm being rotatable in first and second directions wherein the second roll is coupled to the arm so that the ends of the second roll are not enclosed by the arm in a manner that allows the second roll to be easily rotatable and removable;

a cam; and at least one spring positioned to resiliently bias the arm and the cam;

wherein the cam is selectively rotatable to cause the arm to rotate in the first direction which moves the second roll toward the first roll or belt, or to cause the arm to rotate in the second direction which moves the second roll away from the first roll or belt, and includes a contoured surface having a plurality of settings including at least:

a first setting at which the second surface is positioned to contact the first surface and form the nip having a first width in a process direction of the apparatus;

a second setting at which the second surface is positioned to contact the first surface and form the nip having a second width larger than the first width in the process direction;

a third setting at which the second surface is positioned out of contact with the first surface; and a fourth setting that provides the smallest width during heating and cooling of the second roll to produce less stress on the belt, the second roll and the roll positioning device.

8. The method of claim 7, wherein the heating heats the first surface of the first roll.

9. The method of claim 7, wherein the heating heats the first surface of the belt.

10. The method of claim 7, comprising positioning the second surface of the second roll in contact with the first surface of the first roll or belt to form the nip and increase the temperature of the second surface from ambient temperature to the first temperature during warm-up of the apparatus.

11. The method of claim 7, wherein the first temperature is a selected maximum temperature of the second surface of the second roll, the second temperature is a selected minimum temperature of the second surface, and each of the first temperature and second temperature is within about 3° C. to about 10° C. of a target temperature of the second surface.

12. The method of claim 7, comprising adjusting the position of the second surface of the second roll in contact with the first surface of the first roll or belt to vary a width of the nip in a process direction of the apparatus.

13. The method of claim 7, wherein:

the belt has a thickness of about 0.1 mm to about 0.6 mm; and the second roll includes a layer comprised of an elastomeric material which is deformed when the second surface contacts the first surface to form the nip.

* * * * *